US005632814A

United States Patent [19]

Wohlfeil et al.

[11] Patent Number: 5,632,814

[45] Date of Patent: May 27, 1997

[54] DEVICE FOR APPLYING A COATING MATERIAL TO A RUNNING WEB

[75] Inventors: Gerhard Wohlfeil, Monheim; Herbert Sommer, Düsseldorf, both of Germany

[73] Assignee: Jagenberg Aktiengesellschaft, Dusseldorf, Germany

[21] Appl. No.: 400,278

[22] Filed: Mar. 3, 1995

Related U.S. Application Data

[63] Continuation of Ser. No. 87,816, filed as PCT/EP92/02996, Dec. 24, 1992, published as WO93/17181, Sep. 2, 1993 abandoned.

[30] Foreign Application Priority Data

Feb. 27, 1992 [DE] Germany ..... 42 05 993.3

[51] Int. Cl.[6] ..... B05C 3/00

[52] U.S. Cl. ..... 118/261; 118/410; 118/413; 427/356

[58] Field of Search ..... 118/126, 249, 118/258, 261, 262, 410, 413, 414; 427/356

[56] References Cited

U.S. PATENT DOCUMENTS

| | | | |
|---|---|---|---|
| 3,245,377 | 4/1966 | Gettel | 118/249 |
| 4,279,949 | 7/1981 | Esser | 3/12 |
| 4,387,124 | 6/1983 | Pipkin | 427/356 |
| 4,887,547 | 12/1989 | Sommer et al. | 118/410 |
| 5,119,755 | 6/1992 | Beisswanger | 118/261 X |
| 5,179,909 | 1/1993 | Sollinger | 118/262 X |

FOREIGN PATENT DOCUMENTS

| | | |
|---|---|---|
| 0 399 147 | 11/1990 | European Pat. Off. . |
| 885372 | 5/1990 | Finland . |
| 904876 | 4/1991 | Finland . |
| 36 20 374 | 2/1987 | Germany . |
| 85 22 036 | 4/1987 | Germany . |

OTHER PUBLICATIONS

H. Ruckert und H. Sommer; "Erste Erfahrungen mit Neuentwicklungen von Auftrag—und Dosiersystemen—Hydro–Bar und Jetcoat"; Wochenblatt Fur Papierfabrikation 23/24—1983; pp. 875–878, 880–881, 884–885.

*Primary Examiner*—James Engel

*Attorney, Agent, or Firm*—Herbert Dubno; Andrew Wilford

[57] ABSTRACT

For the application of a coating material onto a running material web, particularly a paper or cardboard web, a cylinder guides the web of material while a dosing element extends over the work width and has a surface which together with the cylinder forms an application gap converging in the travel direction of the web. In order to be able to apply various coating materials at high web speeds evenly and without disturbances, even at low application weights, the dosing element is supported swingably about an axis parallel to the cylinder, the radius of its surface guiding the coating material increases continuously in the travel direction of the web up to the dosing line and the surface ends at the dosing line with an edge whose radius is less than 8 mm.

8 Claims, 4 Drawing Sheets

FIG. 2
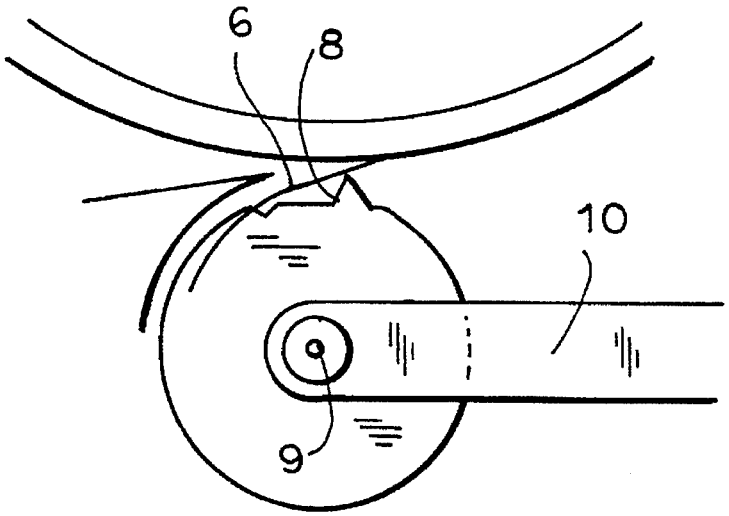
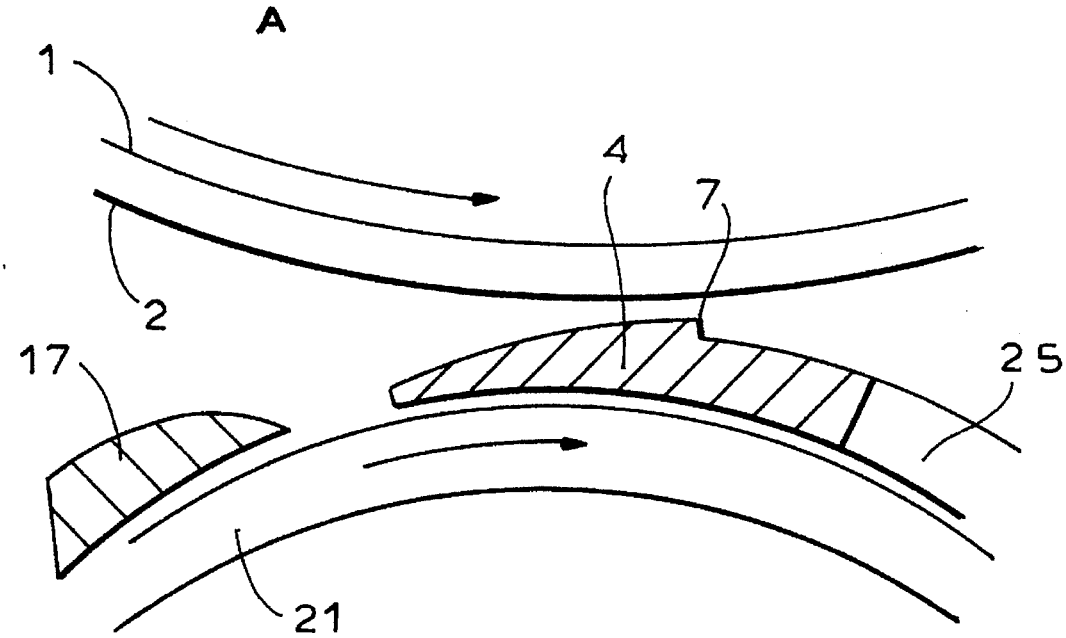
FIG. 4

DEVICE FOR APPLYING A COATING MATERIAL TO A RUNNING WEB

This application is a file-wrapper-continuation of patent application Ser. No. 08/087,816 filed 8 Jul. 1993 now abandoned as the US national phase of PCT/EP92/02996 itself filed 24 Dec. 1992 published as WO93/17181, Sep. 2, 1993 with a claim to the priority of German patent application P 42 05 993.3 itself filed 27 Feb. 1992.

FIELD OF THE INVENTION

The invention relates to a device for the application of a coating material to a running web of material, particularly a paper or cardboard web.

BACKGROUND OF THE INVENTION

For the coating of running webs, particularly of paper or cardboard, devices having a backing cylinder guiding the web are known where an application system with a dosing element for setting the desired coating weight is mounted in the area where the cylinder is wrapped by the web. The surface of the dosing element extending over the working width and the cylinder together create a gap converging in the direction of the web travel, through which the coating material is guided towards the web. The desired coating weight can be set by control of the gap width at the narrowest point of the application gap, which is called the dosing or metering line. In order to improve the coating quality and/or to reduce the coating weight (applied amount of coating material per square meter of web surface), it is known to provide an additional dosing or metering system beyond the application system, which wipes off the excess of the predosed applied coating, e.g. with a wiper blade, bringing it to the desired coating weight.

DE-OS 39 16 620 describes a coating cylinder dipping into a liquid-containing chamber and forming an application gap with the cylinder. A nonelastically supported predosing unit, reaching into the area of the application gap and closing it to define a chamber on the outgoing side, forms a predosing gap together with the cylinder, whereby an outflow channel is left free towards the coating cylinder.

DE-OS 36 20 374 describes a device without an immersed coating cylinder, wherein the coating material is pumped through a channel into the converging gap between the cylinder and the wiper element. Rotating wiper bars or distributor elements with a curved cross section, which are elastically supported and can be pressed against the cylinder are provided as wiper elements, in order to set the line pressure at the dosing line.

In the coating of absorbent paper or cardboard webs the coating material—usually a coating dye in an aqueous solution—has to be fed to the web with as low a pressure as is possible, in order to prevent an undesired penetration into the web. It must be ensured that the coating dye is evenly distributed and that uncoated portions are avoided. If after the application an additional final dosing system is effected, the removal of the excess also must be as even and as small as possible. In practice it has proven difficult to achieve this with coating dyes of various compositions and at ever increasing web speeds without undesired side effects, such as film splitting, high wear, etc.

OBJECT OF THE INVENTION

It is the object of the invention to provide an improved device for the application of a coating material, so that various coating substances can be applied evenly and trouble-free at high web speeds and also at a low coating weight.

SUMMARY OF THE INVENTION

According to the invention, the dosing element is supported swingably about an axis parallel to the cylinder and the radius or distance from the swing axis of the surface guiding the coating material increases continuously in the travel direction of the web up to the dosing line which is the narrowest part of the application gap. This surface of the dosing element ends at the dosing line with an edge whose radius is less than 8 mm.

According to the invention the converging gap can be modified for setting the hydrodynamic pressure and the gap width at the dosing line. The edge with the small radius at the dosing line avoids film splitting, thereby leading to a more even coating.

According to the invention, moreover, the dosing element can be supported on a cylindrical support element parallel to the cylinder and whose axis is coaxial with the swing axis. The support element can be formed in part by a driven coating cylinder transporting the coating material to the application gap.

The gap width at the dosing line can be less than 2 mm and the length of the surface of the dosing element in the travel direction of the web can range between 5 mm and 50 mm.

The edge of the dosing line can be formed by a rotatable wiper rod.

Preferably the dosing element is nonelastically supported.

In an embodiment of the invention, before or upstream of the dosing element in the travel direction of the web, a baffle extending over the work width is provided and together with the support element can form a supply channel for the coating material, reaching the application gap or terminating shortly before the gap.

The dosing element can be supported on a cylindrical support element parallel to the axis of the cylinder and swingable about an axis which is coaxial with the cylinder axis of the support element. This solution is structurally advantageous since it can be built into already existing installations with coating cylinders.

The support element can be driven cylinder feeding the coating material into the application gap and taking over the function of a pump, whose rotational speed can be used to influence the amount supplied to the dosing/predosing gap.

The rotatable wiper bar at the dosing line insures longer dwelling times and a self-cleaning of the dosing/predosing element, since it is subjected to considerably less wear than a stationary dosing element.

The fact that the dosing element is nonelastically supported makes it possible to set a certain gap width at the dosing line, independently of the hydrodynamic pressure. Alternatively it is also possible to establish a certain hydrodynamic pressure, in which case the dosing element is pressed with a preselected pressure against the cylinder.

Due to the baffle arranged before the dosing element in the travel direction of the web, the dye flow to the application gap is calmed down. This insures a more even application and makes this way possible to reduce the pressure in the application gap, so that there are no uncovered spots on the web.

BRIEF DESCRIPTION OF THE DRAWING

The above and other objects, features, and advantages will become more readily apparent from the following description reference being made to the accompanying drawing in which:

FIG. 2 is a diagrammatic side view which shows an embodiment with a supported wiper blade as dosing element;

FIG. 4 is an enlarged detail of FIG. 3; and

SPECIFIC DESCRIPTION

Figure 1:
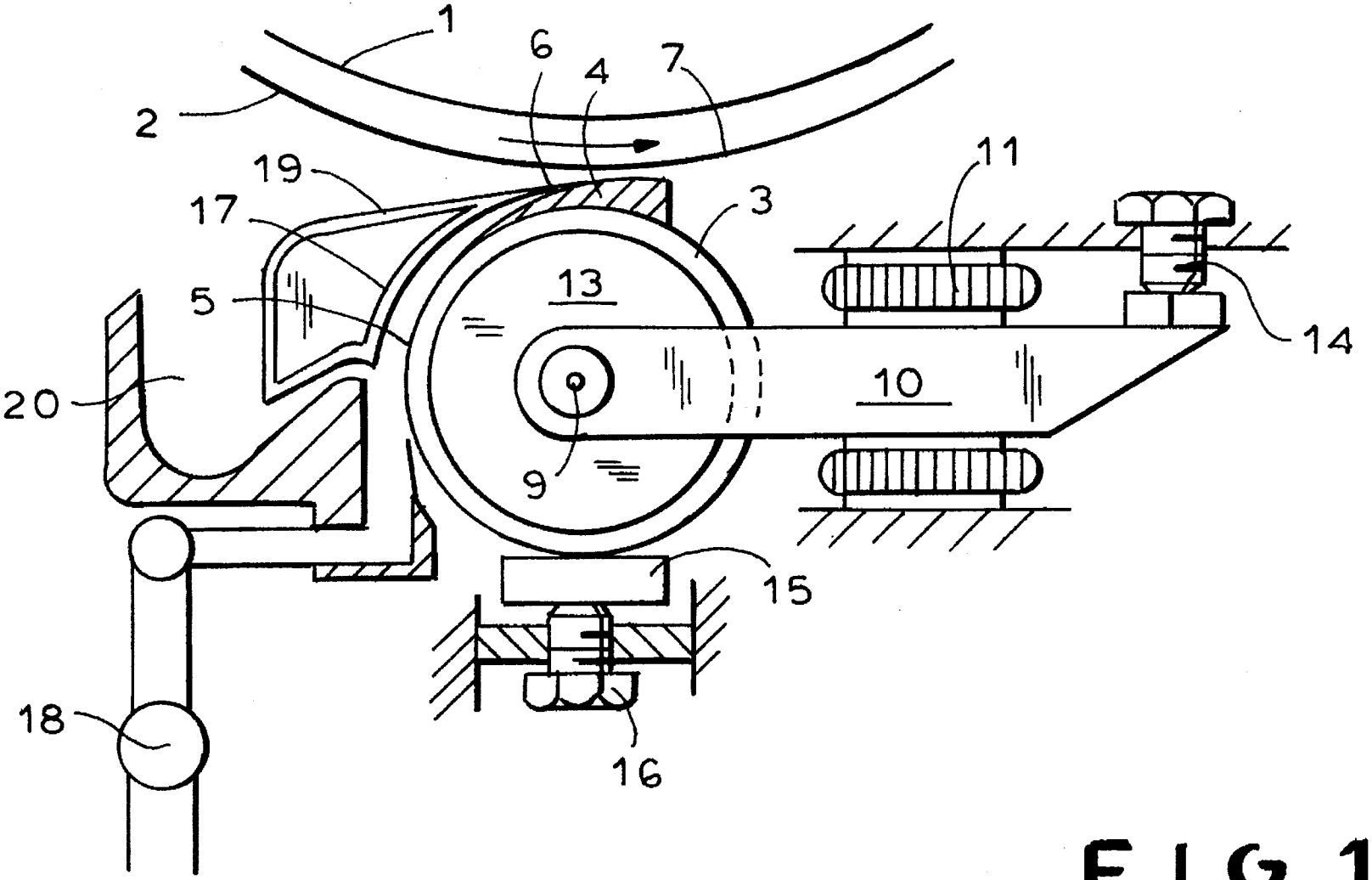
FIG. 1 is a lateral view, partly in section, of a device with a wedge-shaped dosing element, fastened on a swingable cylindrical support element.

In all embodiments illustrated in the drawing the coating device has a driven cylinder 1, which guides the web of material 2—a paper or cardboard web with a width of 8 m or more. In the area where the web 2 wraps around the cylinder a cylindrical support element 3 parallel to the cylinder 1 is arranged at a distance from the web and supports a dosing element 4 provided in the space between the support element 3 and the cylinder 1.

In the travel direction of the web, upstream of the dosing element 4 there is a supply channel 5 through which the coating material—in this case coating dye—is directed over the surface 6 of dosing element 4 to the web 2. The surface 6 of the dosing element 4 facing the cylinder 1 forms together with the cylinder 1 an application gap converging in the direction of the web travel. The gap width at the narrowest point (dosing line 7) is less than 2 mm. The aforedescribed elements (cylinder 1, support element 3, dosing element 4, supply channel 5) extend over the entire work width, i.e. the width of web 2, and the cross section remains the same across the width of the web. The length of surface 6 of the dosing element 4 measured in the travel direction of the web up to the dosing line 7 ranges between 5 mm and 50 mm.

In the embodiments of FIG. 1 and 2 the dosing element 4 is rigidly mounted on the periphery of the support element 3. Its surface 6 guiding the coating dye extends in the web travel direction (in the figures from left to right) approximately tangentially diverging with increasing distance from the shell surface of the support element 3 in the opposite direction.

In the embodiment of FIG. 1 this construction takes the form of a dosing element 6 with wedge-shaped cross section. In the embodiment of FIG. 2 it takes the form of a wiper blade 8 fastened and supported correspondingly on the outer surface of support element 3. The support element 3 is supported so that it can swivel within limits about a pivot axis 9. The swivel motion is performed with the aid of two levers 10 mounted to each end of the support element 3, these levers being swingable by means of two pneumatic cylinders 11, 12 movable in opposite directions.

Since the distance, marked as radius 13, between the surface 6 and the swivel axle 9 of the dosing element 6 increases continuously in the travel direction of the web up to the dosing line 7, the geometry of the application gap which it forms together with the cylinder 1, as well as the width of the gap at the dosing line 7 can be set by changing the position of support element 3. The counterclockwise swivel motion of the dosing element 4 which reduces the gap width at the dosing line 7 is limited by a mechanical stop 14, so that a minimal gap width can be preserved. Alternately, a certain hydrodynamic pressure can be established, whereby the gap width is variable. Then in the pneumatic cylinder 12 a certain pressure is established without a mechanical stop, leading to the buildup of a corresponding hydrodynamic pressure in the application gap.

If the pressure in the application gap surpasses the pressure generated by the pneumatic cylinder 12, the dosing element 4 gives way and opens the application gap; for instance when a splice bump of the paper web passes through the gap.

To insure that the application gap extends with a uniform cross section over the work width, the support element 3 is preferably designed as a hollow body with double walls, traversed by a cooling liquid. This way thermal deformations which could be transmitted to the dosing element 4 are avoided. At the same time the cooling reduces the deposition of coating dye. By comparison to the known coating cylinders, the support element 3 can be relatively slim. In the case of large work widths it is supported at its underside, in order to avoid bending. As shown in FIG. 1, this is suitably done with a throughgoing bar 15, pressed against the underside by a row of set screws 16.

The surface 6 of the dosing element 4 ends at the dosing line 7 with an edge whose radius is smaller than 8 mm. In this way the edge sets an abrupt end to the application gap at the dosing line 7, in order to keep the radial forces originating from cylinder 1 and acting upon the coating dye as low as possible. These forces can lead to the disadvantageous film-splitting effect, which has a negative influence on the uniformity of the coating.

In the travel direction of the web in front of the dosing element 4 a baffle 17 is provided, which is curved to fit the outer shell surface of support element 3 and runs at a distance from the latter, the two together forming the supply channel 5 feeding the coating dye to the application gap. The baffle 17 reaches into the application gap or ends at a short distance from the dosing element 4. The coating dye is pumped in excess into the supply channel 5 by the adjustable pump 18. The excess amount, separated from the onflowing coating dye by baffle 17, returns against the travel direction of the web, over the backside 19 into a collecting vat 20. Due to the separation between the onflowing and the backflowing coating dye the stream in the application gap 6 is considerably calmed down, so that the pressure can be reduced without leaving uncovered spots.

Figure 3:
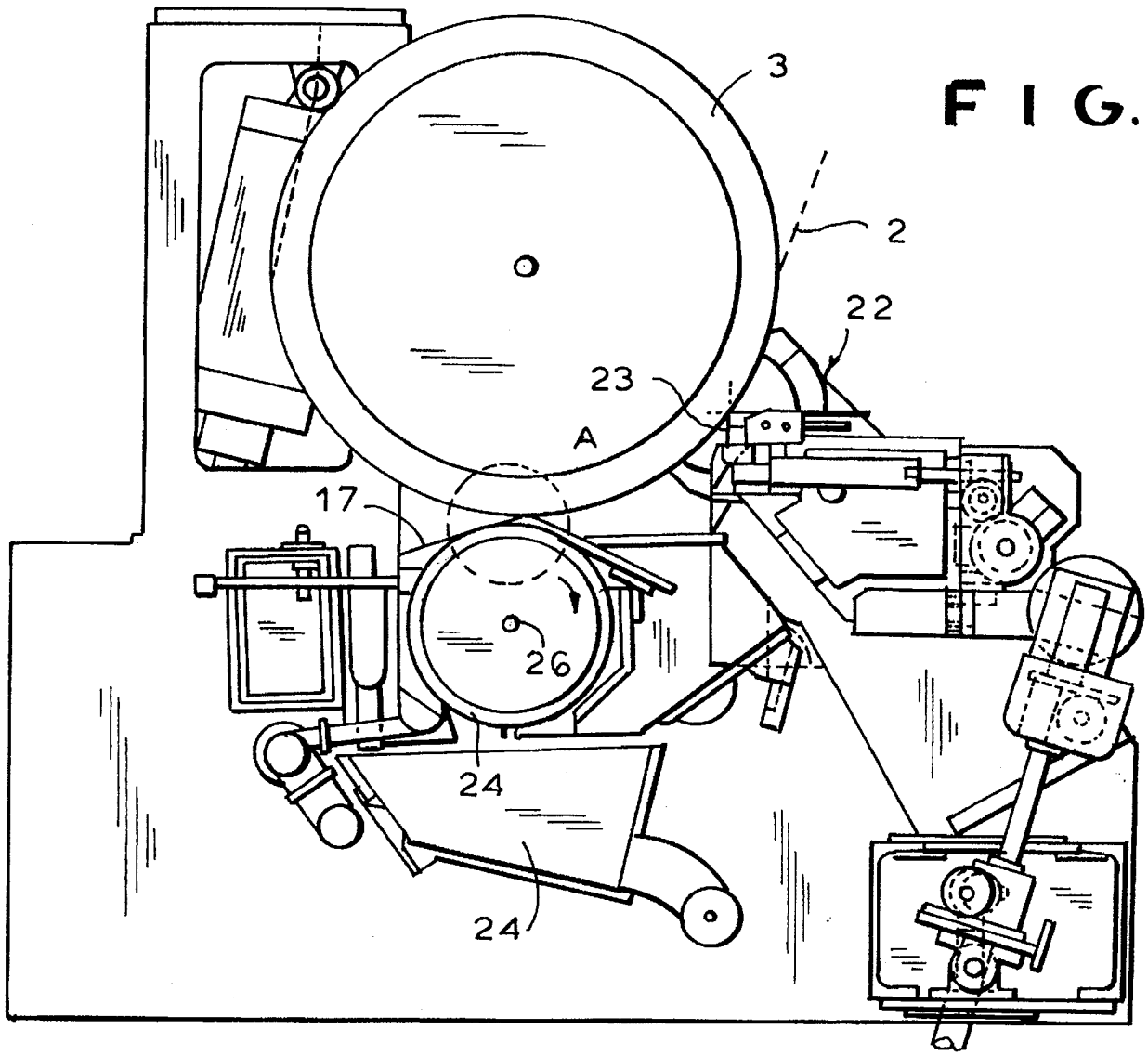
FIG. 3 is a lateral view of a device with a dipping coating cylinder.

In the embodiment shown in FIG. 3, the support element consists of a driven cylinder 21 feeding the coating dye to the application gap. An additional final dosing element 22 is connected to the coating device and has a wiper blade 23, which can be pressed in the known manner against the web 2 guided by cylinder 1, with an adjustable angle and contact pressure. The coating dye scraped off by the wiper blade 23 runs into a dye vat 24 arranged underneath the coating cylinder 21, from where it is transported to the application gap together with a fresh stream of coating dye. On the incoming side of the web there is also a baffle 17, which separates the oncoming flow from the backflowing excess, as described above. The area of the application gap with the dosing element 6 is shown enlarged in FIG. 4.

The dosing element 4 has also a wedge-shaped cross section and ends at the dosing line with a sharp edge. However, it is not fastened to the cylinder 21, but only rests against it. The coating cylinder 21 rotates under the dosing element in order to feed the coating dye to the application gap. In this embodiment the gap width at the dosing line is also of maximum 2 mm and the length surface 6 of the dosing element guiding the coating dye up to the dosing line 7 ranges between 5 mm and 50 mm. The baffle 17 reaches close to the application gap, the distance of its end from the dosing line 7 being of maximum 80 mm. The dosing element 4 is mounted at the end of a rocking lever 25, which can swing about the rotation axis 26 of the coating cylinder 21, in order to set the geometry of the application gap in the manner described in the embodiment of FIG. 1.

Figure 5:
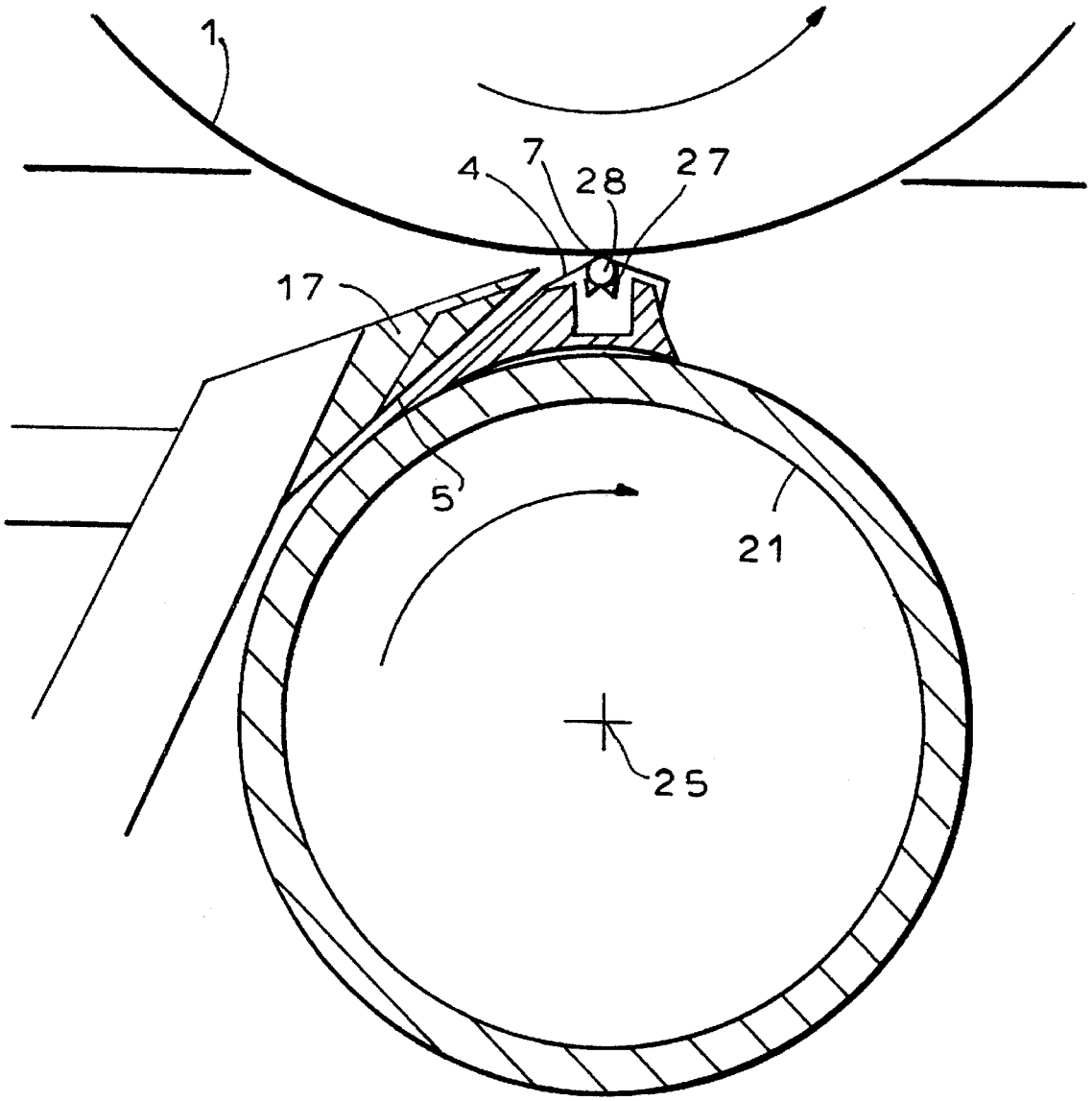
FIG. 5 is a view similar to FIG. 4 which shows a device wherein the dosing line is defined by a rotatable wiper bar.

FIG. 5 also shows an embodiment with a coating cylinder 21 supplying the coating dye to the supply channel 5. The dosing element 4 is supported so that it can swing about the rotation axis 26 of the coating cylinder 21—as described in the embodiments of FIGS. 3 and 4. It has a wedge-shaped incoming flank, which together with the baffle 17 creates the supply channel 5. In the area of the dosing line 7, a holder 27 for a rotatable wiper rod 28 is fitted into the dosing element 4. The outer shell surface of the driven wiper rod 29 is either smooth or has projections and depressions, preferably in the form of peripheral grooves, which can be created for instance by wrapping with a wire or by making annular or spiral-shaped grooves. The circumference of the wiper rod 28 connects tangentially with the incoming flank, so that it forms the cutoff edge at the dosing line 7. In order to minimize the film-splitting effect, the maximal radius of wiper rod 28 is 8 mm, suitably it is entrained by the drive of the coating cylinder 21. The embodiment of FIG. 5 has the advantage that the wear of the wiper rod 28 at the critical point, namely the dosing line 7, is considerably lower than the wear of a rigid dosing element in this area. Furthermore, the worn out wiper rod 28 can be simply replaced.

We claim:

1. A device for coating a flowable substance onto a traveling web moving in a travel direction, the device comprising:

a backing cylinder having a cylinder surface centered on an axis and over which the web travels in the direction;

an inelastic dosing element spacedly juxtaposed with the cylinder surface and with the web, extending a full working width across the web, and having a dosing surface converging toward the cylinder surface in the direction and defining with the cylinder surface an application gap having a narrowest spacing at a dosing line;

a baffle having a baffle surface radially confronting and spacedly juxtaposed with the dosing surface and forming therewith a feed channel having an upstream end remote from the cylinder surface and a downstream end at the gap;

means for supporting the dosing element for swinging movement of the dosing element about a swing axis parallel to the axis of the cylinder with the dosing element moving substantially only generally parallel to the dosing surface and tangentially of the cylinder surface and not radially of the backing cylinder to change the spacing between the cylinder surface and the dosing surface at the dosing line, the dosing surface being at a radial distance from the swing axis which increases continuously in the travel direction to the dosing line; and means for feeding the flowable substance to the upstream end of the feed channel and through the channel to the gap.

2. The device defined in claim 1 wherein the dosing surface has at the dosing line an edge of a radius less than 8 mm.

3. The device defined in claim 1 wherein the means for supporting the dosing element includes a cylindrical support element parallel to the guide cylinder and having an axis coaxial with the swing axis.

4. The device defined in claim 1 wherein the means for feeding includes a driven coating cylinder for transporting the substance to the gap, the dosing element being disposed between the cylinders.

5. The device defined in claim 1 wherein the gap has a gap width at the dosing line of less than 2 mm.

6. The device defined in claim 1 wherein the dosing surface has a length in the direction between 5 mm and 50 mm.

7. The device defined in claim 1 wherein the edge is formed by a rotatable wiper rod.

8. A device for coating a flowable substance onto a traveling web moving in a travel direction, the device comprising:

a backing cylinder having a cylinder surface centered on an axis and over which the web travels in the direction;

an inelastic dosing element spacedly juxtaposed with the cylinder surface and with the web, extending a full working width across the web, and having a dosing surface converging toward the cylinder surface in the direction and defining with the cylinder surface an application gap having a narrowest spacing at a dosing line;

means for supporting the dosing element for swinging movement of the dosing element about a swing axis parallel to the axis of the cylinder with the dosing element moving substantially only generally parallel to the dosing surface and tangentially of the cylinder surface and not radially of the backing cylinder to change the spacing between the cylinder surface and the dosing surface at the dosing line, the dosing surface being at a radial distance from the swing axis which increases continuously in the travel direction to the dosing line, the dosing surface having at the dosing line an edge of a radius less than 8 mm; and means for feeding the flowable substance to the gap including a driven coating cylinder for transporting the substance to the gap, the inelastic dosing element sliding on an outer surface of the coating cylinder.

* * * * *